US009972194B2

(12) United States Patent
Eskildsen et al.

(10) Patent No.: US 9,972,194 B2
(45) **Date of Patent: *May 15, 2018**

(54) SYSTEM AND METHOD FOR TAKE-OVER PROTECTION FOR A SECURITY SYSTEM

(71) Applicant: Honeywell International Inc., Morristown, NJ (US)

(72) Inventors: Kenneth G. Eskildsen, Greak Neck, NY (US); Mark Douglas Okeefe, San Diego, CA (US); Doug Marshall, Sugarland, TX (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/345,888

(22) Filed: Nov. 8, 2016

(65) Prior Publication Data

US 2017/0053524 A1 Feb. 23, 2017

Related U.S. Application Data

(63) Continuation of application No. 14/557,733, filed on Dec. 2, 2014, now Pat. No. 9,495,861.

(51) Int. Cl.

| | |
|---|---|
| ***G08B 1/08*** | (2006.01) |
| ***G08B 25/14*** | (2006.01) |
| ***G08B 25/00*** | (2006.01) |
| ***G08B 25/10*** | (2006.01) |

(52) U.S. Cl.

CPC ..... *G08B 25/14* (2013.01); *G08B 25/003* (2013.01); *G08B 25/008* (2013.01); *G08B 25/10* (2013.01); *G08B 25/007* (2013.01)

(58) Field of Classification Search

CPC ..... G08B 25/03; H04L 63/02
USPC .. 340/539.19, 545.1, 541, 545.2, 545.9, 3.1, 340/3.3, 3.32, 506; 726/19
See application file for complete search history.

(56) References Cited

U.S. PATENT DOCUMENTS

| | | | |
|---|---|---|---|
| 5,907,279 | A | 5/1999 | Bruins et al. |
| 7,728,724 | B1 | 6/2010 | Scalisi et al. |
| 8,086,702 | B2 | 12/2011 | Baum et al. |
| 8,086,703 | B2 | 12/2011 | Baum et al. |
| 8,122,131 | B2 | 2/2012 | Baum et al. |
| 8,456,278 | B1 | 6/2013 | Bergman et al. |
| 8,638,210 | B2 | 6/2014 | Simon et al. |

(Continued)

OTHER PUBLICATIONS

Extended European Search Report, dated Feb. 5, 2016, corresponding to European Application No. EP 15 19 5744.

*Primary Examiner* — Toan N Pham
(74) *Attorney, Agent, or Firm* — Husch Blackwell LLP

(57) ABSTRACT

Systems and methods for take-over protection for a system are provided. Methods can include a module of the system storing, in a memory device of the module, a control panel identifier of a control panel of the system, the module requesting that the control panel communicates the control panel identifier to the module, the module receiving the control panel identifier from the control panel, the module comparing the control panel identifier received from the control panel with the control panel identifier stored in the memory device, and the module initiating communications with the control panel when the control panel identifier received from the control panel matches the control panel identifier stored in the memory device.

14 Claims, 2 Drawing Sheets

(56) References Cited

U.S. PATENT DOCUMENTS

| | | | | |
|---|---|---|---|---|
| 8,996,665 | B2 | 3/2015 | Baum et al. | |
| 9,495,861 | B2 * | 11/2016 | Eskildsen ..... | G08B 25/14 |
| 2013/0009775 | A1 | 1/2013 | Egawa | |
| 2015/0334087 | A1 | 11/2015 | Dawes | |

* cited by examiner

SYSTEM AND METHOD FOR TAKE-OVER PROTECTION FOR A SECURITY SYSTEM

CROSS-REFERENCE TO RELATED APPLICATIONS

This application is a continuation of and claims the benefit of the filing date of U.S. application Ser. No. 14/557,733 filed Dec. 2, 2014, now U.S. Pat. No. 9,495,861.

FIELD

The application pertains to regional monitoring or control systems. More particularly, the application pertains to security or ambient condition monitoring systems, wherein system components, detectors, or control elements limit their communications to known or pre-determined system control units.

BACKGROUND

Security dealers provide security systems to protect people's lives and property. There are various segments to the security business market ranging from high end installations to basic, low-cost solutions. A basic, low-cost solution is usually offered to a consumer at a cost lower than the cost of security equipment with the expectation that the cost will be recovered via a monthly monitoring fee. Problems arise when a competing security dealer offers the consumer a lower monthly monitoring fee and "takes over" the installed security equipment.

"Taking over" a security system saves the competitor the time and expense of installing the security system. The process of "taking over" the security system involves removing an existing control panel, installing a new control panel, and configuring the control panel to accept signals from existing security sensors. Hence, the savings are realized by the reuse of the existing sensors that were provided by the original security dealer.

DETAILED DESCRIPTION

Figure 1:
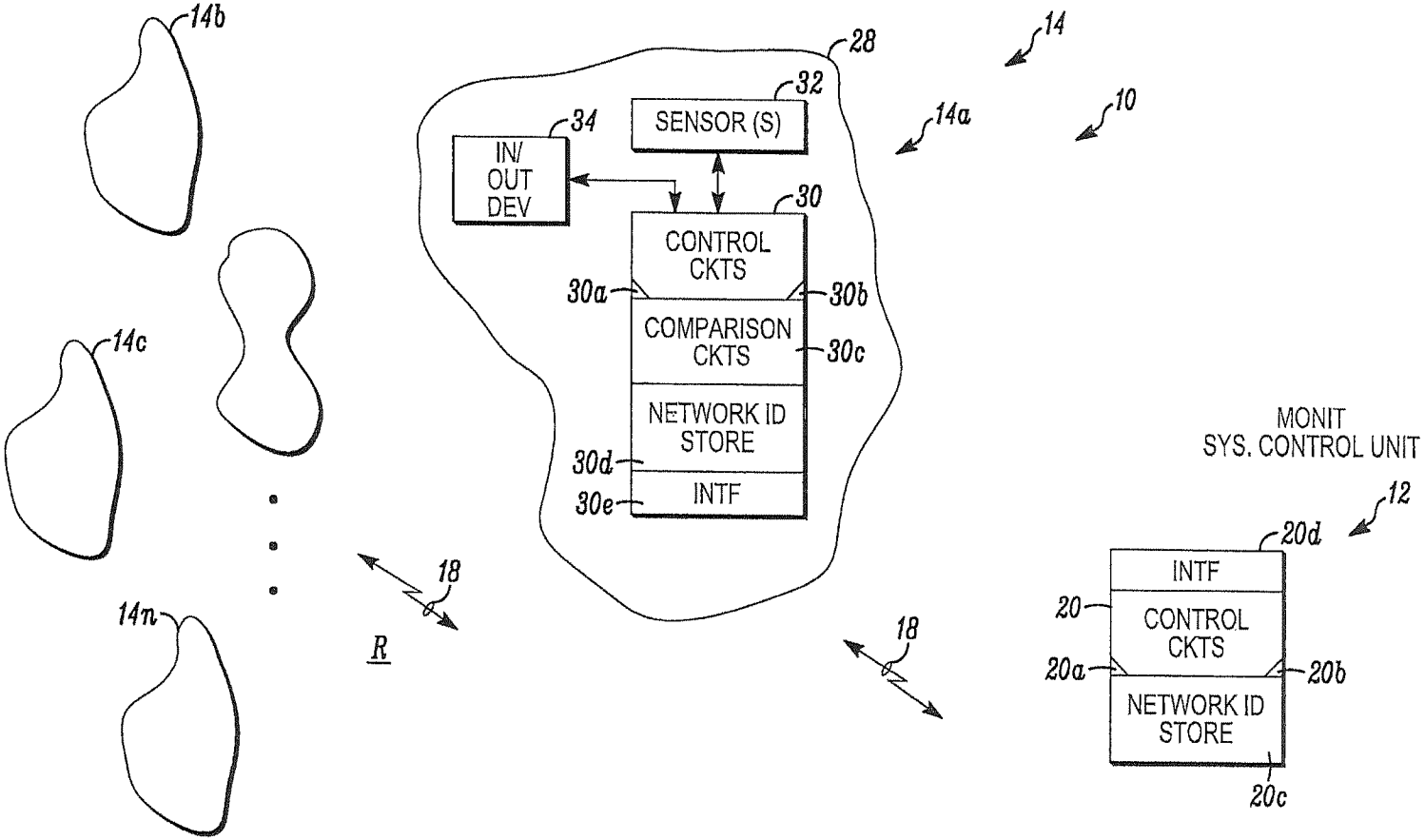
FIG. 1 is a block diagram of a system in accordance herewith.

While disclosed embodiments can take many different forms, specific embodiments hereof are shown in the drawings and will be described herein in detail with the understanding that the present disclosure is to be considered as an exemplification of the principles hereof, as well as the best mode of practicing the same, and is not intended to limit the claims hereof to the specific embodiment illustrated.

In embodiments hereof, the problem is solved by pairing members of a plurality of system modules, such as security sensors, control elements, or ambient condition detectors, with a system control panel or system control circuits. In a disclosed embodiment, the modules, for example, the sensors, control elements, or detectors, without limitation, will only communicate with the system control circuits provided by a security dealer that installed the entire system.

Should a competing dealer try to "take over" the system by removing the control circuits or panel, the existing modules, whether they be implemented as sensors, ambient condition detectors, or control elements, will not communicate with the new control system or panel. Therefore, the entire system (panel and modules) will need to be replaced to take over the system.

In one aspect hereof, only an authorized user can remove a sensor, detector, or peripheral from a security system and reuse the removed module with a different security system.

The authorized user can be the dealer, installer, or other person assigned by the dealer (perhaps the end user). There are many ways to determine if a user is "authorized," such as the use of an authorized user code, biometric identifier, password, etc. Once the user is authenticated, the removal and reuse of the respective module is permitted.

In a disclosed embodiment, two-way RF modules are coupled to an integral RF modular network identifier (ID). The network ID is derived from, for example, a MAC address that is stored in the control panel. This MAC address is unique to the control panel and in the domain of MAC addresses. Other identifiers can be used without departing from the spirit and scope hereof.

When a module is enrolled into the control panel, the control panel provides the network ID to that module. The network ID is stored in non-volatile memory in the module. Whenever the module communicates with the control panel, the module verifies the network ID of the panel. If the received ID does not match the pre-stored ID, then the module will cease communications with that panel.

FIG. 1 illustrates a monitoring system 10 that has a local control unit 12. A plurality of modules 14 can be in bidirectional wired or wireless RF communications with the control unit 12. Members of the plurality 14, such as 14*a*, 14*b* . . . 14*n*, can be installed throughout a region R of interest. The members of the plurality 14 can include, without limitation, motion detectors, position detectors, glass break detectors, smoke detectors, flame detectors, gas detectors, thermal detectors, door access control modules, and authorizing modules.

The control unit 12 and the members 14*a*, 14*b* . . . 14*n* of the plurality of modules 14 can be in bidirectional communication as would be understood by those of skill in the art. A communications medium 18 can be wired or wireless, without limitation.

The control unit or panel 12 can include control circuits 20 that can be implemented, at least in part, with one or more programmable processors 20*a* and associated executable control software or instructions 20*b*.

A unique network identifier 20*c* can be assigned to the system 10 and stored in non-volatile storage 20*c*. An input/output wired or wireless interface 20*d* can also be coupled to the control circuits 20.

The module 14*a* is representative of the members of the plurality 14. A discussion of the module 14*a* will also suffice for a discussion of the remaining members of the plurality 14.

The module 14*a* includes a housing 28, which can be mounted to a wall, ceiling, floor, or the like, without limitation, depending on the characteristic thereof. The particular mounting arrangement is not a limitation hereof.

The housing 28 can carry control circuits 30, which can be implemented, at least in part, with one or more programmable processors 30*a* in combination with pre-stored, executable control instructions 30*b*. The control circuits 30 are coupled to comparison circuits 30*c* and to a non-volatile network identification storage unit 30*d*. The control circuits 30 are also coupled to a wired or wireless communications interface 30*e* to implement bidirectional communications with the unit 12 via the medium 18.

The control circuits 30 are also coupled to one or more sensors 32 and/or one or more input/output devices 34. The devices 32, 34 can be selected from a class that includes at least motion detectors, position detectors, glass break detectors, smoke detectors, flame detectors, gas detectors, thermal detectors, door access control modules, solenoid modules, and authorizing modules, all without limitation.

Figure 2:
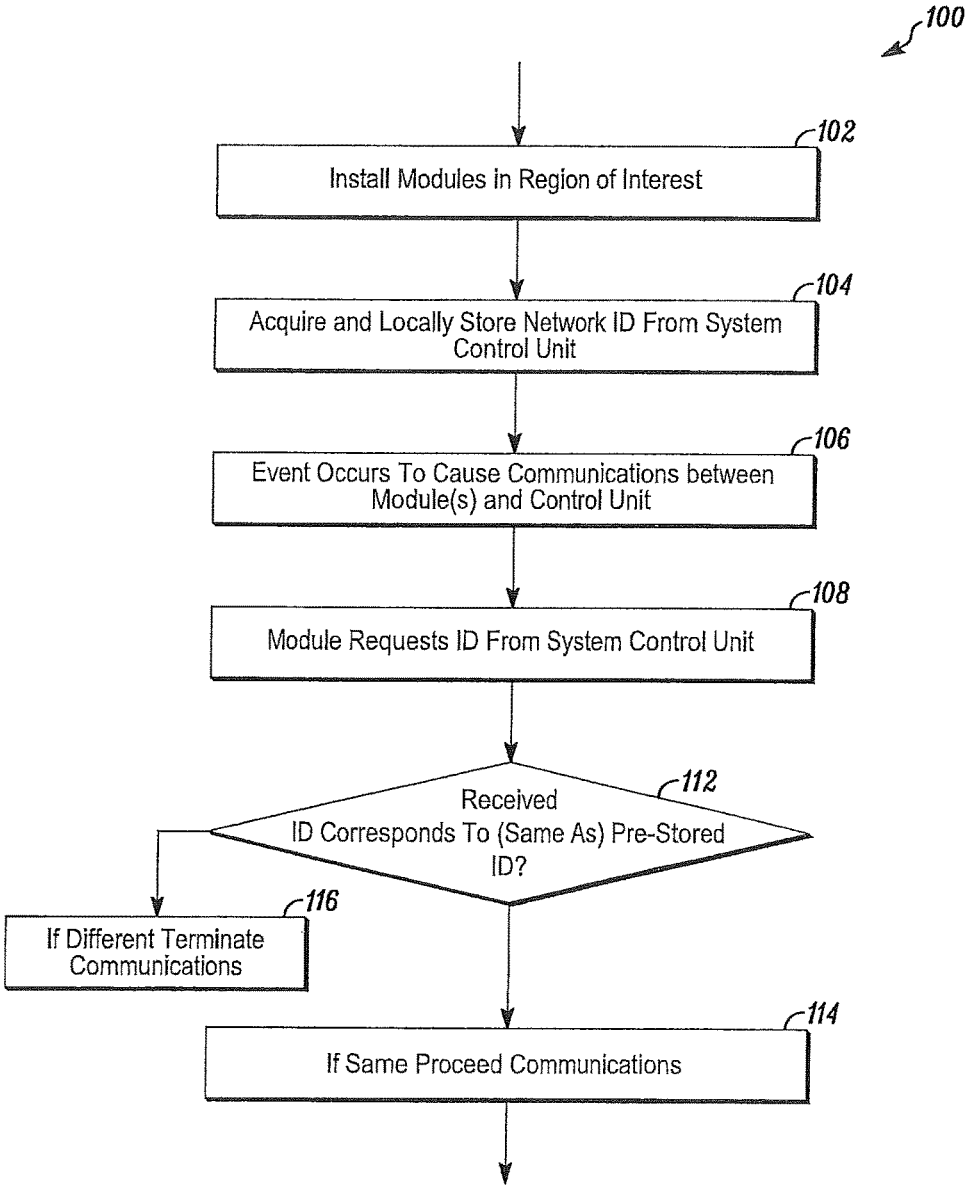
FIG. 2 is a flow diagram in accordance herewith.

FIG. 2 illustrates aspects of a method 100 of operating the system 10. The various modules 14 can be initially installed in the region R as required, as at 102. The method 100 is representative of processing in connection with a group of the modules 14 in an initial system installation or replacement of a single module after installation.

Each of the modules 14 acquires and locally stores the network identifier obtained from the control unit 12 in the unit 30*d*, as at 104. When an event occurs that causes communications to occur between one more members of the plurality 14 and the control unit 12, as at 106, each respective module requests that the control unit 12 transmit a copy of the system identifier stored, for example, in the storage 20*c*, as at 108.

The system identifier received at the module 14*a* from the control unit 12 is compared to the pre-stored identifier in the storage unit 30*d* using the comparison circuits 30*c*, as at 112. If the pre-stored identifier from the unit 30*d* corresponds to or is the same as the received identifier, as at 112, then the communications proceed, as at 114. If not, then the communications are either not initiated or are terminated, as at 116. It will be understood that neither the details as to how the pre-stored identifier is represented at the unit 14*a* nor the exact details of the comparison with the pre-stored identifier and the received identifier are limitations hereof.

As those of skill in the art will understand, there will be various ways for the installer to manage the network ID so that the sensors can be removed, replaced, or repurposed. However, this capability will only be available via secure communications by the dealer that installed the equipment.

Alternate methods may achieve the goal of pairing the module or sensor with the security system and only allowing authorized users to repurpose the sensor. Such other systems or methods that achieve the same result come within the spirit and scope hereof.

In summary, the sensors or detectors are manufactured in a default state. This state enables the sensor to be enrolled with any compatible security system. Once the sensor has been enrolled with the panel, the sensor is no longer in the default state and will only work with the panel with which the sensor has been enrolled. To repurpose, that is, to enroll the sensor with a different panel, the sensor will need to be reset to the default state. Only authorized users can reset the sensor into the default state.

During implementation, for example, during the first 24 hours after enrollment, enrolled sensors can be defaulted at the system control panel by anyone, not just the authorized user. This feature provides a way to deal with enrollment mistakes, such as when the sensor is enrolled with the wrong control panel.

Panel replacement, for example, if the control panel malfunctions and needs to be replaced, is a process available for the authorized user to replace the control panel, and all of the sensors will change their allegiance to the new panel.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, or steps may be eliminated from the described flows, and other components may be added to or removed from the described embodiments.

The invention claimed is:

1. A method comprising:

a module of a monitoring system storing, in a memory device of the module, a control panel identifier of a control panel of the monitoring system;

the module requesting that the control panel communicates the control panel identifier to the module;

the module receiving the control panel identifier from the control panel;

the module comparing the control panel identifier received from the control panel with the control panel identifier stored in the memory device; and the module initiating communications with the control panel when the control panel identifier received from the control panel matches the control panel identifier stored in the memory device.

2. The method of claim 1 wherein the memory device includes a non-volatile storage device.

3. The method of claim 1 wherein the module includes an ambient condition detector, a motion detector, a position detector, a glass break detector, a smoke detector, a flame detector, a gas detector, a thermal detector, a door access control module, or an authorizing module.

4. The method of claim 1 wherein the monitoring system includes a heating ventilating and air conditioning system, a fire detection system, a gas detection system, or a security monitoring system.

5. A system comprising:

a transceiver device;

a memory device;

a programmable processor; and executable control software stored on a non-transitory computer readable medium, wherein the memory device stores a control panel identifier of a control panel, wherein the programmable processor and the executable control software request, via the transceiver, that the control panel communicates the control panel identifier to the transceiver, wherein the programmable processor and the executable control software receive, via the transceiver, the control panel identifier from the control panel, wherein the programmable processor and the executable control software compare the control panel identifier received from the control panel with the control panel identifier stored in the memory device, and wherein the programmable processor and the executable control software initiate, via the transceiver, communications with the control panel identifier when the control panel identifier received from the control panel matches the control panel identifier stored in the memory device.

6. The system of claim 5 wherein the memory device includes a non-volatile storage device.

7. The system of claim 5 further comprising an ambient condition detector, a motion detector, a position detector, a glass break detector, a smoke detector, a flame detector, a gas detector, a thermal detector, a door access control module, or an authorizing module.

8. The system of claim 5 further comprising a heating ventilating and air conditioning system, a fire detection system, a gas detection system, or a security monitoring system.

9. A system comprising:

a first control panel; and a first module that stores a first control panel identifier of the first control panel in a first memory device of the first module, wherein the first module requests that the first control panel communicates the first control panel identifier to the first module, wherein, upon receiving the first control panel identifier from the first control panel, the first module compares the first control panel identifier received from the first control panel with the first control panel identifier stored in the first memory device, and wherein the first module initiates communications with the first control panel when the first control panel identifier received from the first control panel matches the first control panel identifier stored in the first memory device.

10. The system of claim 9 wherein the first control panel transmits the first control panel identifier to the first module for storage in the first memory device upon detecting that the first module is installed in the system.

11. The system of claim 9 further comprising:

a second module that stores a second control panel identifier of a second control panel in a second memory device of the second module, wherein the second module requests that the first control panel communicates the first control panel identifier to the second module, wherein, upon receiving the first control panel identifier from the first control panel, the second module compares the first control panel identifier received from the first control panel with the second control panel identifier stored in the second memory device, and wherein the second module abstains from initiating the communications with the first control panel when the first control panel identifier received from the first control panel fails to match the second control panel identifier stored in the second memory device.

12. The system of claim 11 wherein the first memory device includes a non-volatile storage device.

13. The system of claim 11 wherein the first module includes an ambient condition detector, a motion detector, a position detector, a glass break detector, a smoke detector, a flame detector, a gas detector, a thermal detector, a door access control module, or an authorizing module.

14. The system of claim 11 further comprising a heating ventilating and air conditioning system, a fire detection system, a gas detection system, or a security monitoring system.

* * * * *